US005549385A

United States Patent [19]

Goncalves

[11] Patent Number: 5,549,385

[45] Date of Patent: Aug. 27, 1996

[54] DEVICE FOR AIR-SHELTERED PREPARATION OF A PASTE FOR COSMETIC USE

[75] Inventor: Antonin Goncalves, Montmorency, France

[73] Assignee: L'Oreal, Paris, France

[21] Appl. No.: 354,780

[22] Filed: Dec. 12, 1994

[30] Foreign Application Priority Data

Dec. 10, 1993 [FR] France ..... 93 14863

[51] Int. Cl.[6] ..... B01F 7/18

[52] U.S. Cl. ..... 366/314; 366/331

[58] Field of Search ..... 366/279, 241, 366/314, 331, 309, 311, 312, 328.2, 328.1, 328.4, 328.3, 329.1, 342, 343

[56] References Cited

U.S. PATENT DOCUMENTS 1,580,778 4/1926 Coverstone ..... 366/314
2,648,528 8/1953 Persak ..... 366/314
2,904,808 9/1959 Massman .
3,085,281 4/1963 Massman .
3,311,941 4/1967 Buchwalter et al. .

FOREIGN PATENT DOCUMENTS 0325766 8/1980 European Pat. Off. .

*Primary Examiner*—Robert W. Jenkins
*Attorney, Agent, or Firm*—Oliff & Berridge

[57] ABSTRACT

The invention relates to a device for preparing a paste for cosmetic use in a manner sheltered from the air by mixing at least two components of which at least one is in the form of cream. The device has a closed receptacle provided with a removable closing means, into which the components are successively introduced in a metered manner. The receptacle is in the form of a cylindrical pot, closed at its upper part by a removable lid, and having at its base (2) a means (16, 17) forming a bearing to receive rotationally the hub (11) of a shaft (12) disposed along the axis (10) of the cylindrical pot which shaft has, at its periphery, at least one radial blade (18), the device having outside the cylindrical pot a rotatable operating element (9) integral with the hub (11), activatable by hand, whereby activation of the operating element causes the shaft and radial blade or blades to be driven rotationally.

15 Claims, 1 Drawing Sheet

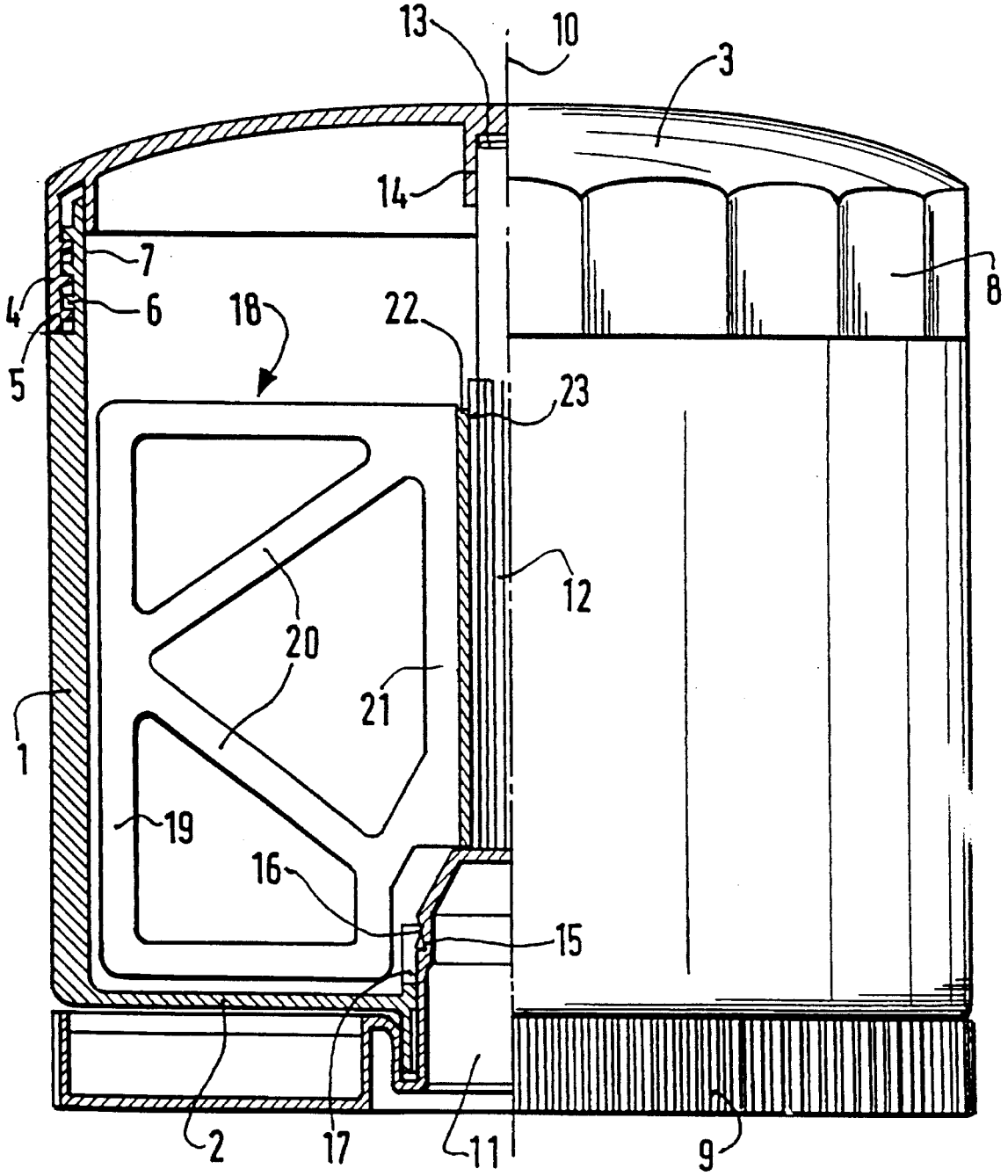
13
10
3
14
7
8
4
6
18
22
5
23
12
20
21
1
19
16
15
2
17
11
9

DEVICE FOR AIR-SHELTERED PREPARATION OF A PASTE FOR COSMETIC USE

BACKGROUND

The present invention relates to a device for preparing a paste for cosmetic use, particularly a paste for dying or bleaching hair, in a way that is sheltered from the air.

Such pastes are generally obtained by mixing, just before use, at least two components of which at least one is in the cream form and the other component or components is/are in the powder form or possibly a cream form with a third liquid component such as a solvent, in particular water, which may be added to the mix to adjust the degree of fluidity of the eventual paste.

Thus, in the preparation of hair dying or bleaching pastes to be applied with a brush, a dye powder or bleaching powder is mixed with an oxidizing cream and the paste formed after mixing is applied to the entire head of hair or applied in streaks for a specific length of time, after which the hair is rinsed with water and dried.

When a powder component is used, it is important to prevent the powder from being blown into a cloud, which is irritating for the nasal mucosa and gives off an unpleasant odor.

Thus, it has been proposed that the components be mixed in a closed receptacle with a removable closing means into which the components are successively metered in. The proposed receptacle was a transparent, flexible plastic bag initially containing the powder component to which the component in the cream form is introduced, after which the mix is prepared by kneading the flexible wall of the bag.

Once the paste mix has reached the desired consistency, it is expelled through the neck of the bag into another receptacle from which it is applied to the hair with the aid of a brush.

Hence the known device involves the use of a receptacle for making the mix and a receptacle for receiving it from the first receptacle with a view to its application.

In addition, U.S. Pat. No. 3,085,281 for example teaches bottles designed to contain products that must be shaken before use, such as nail varnish, provided on the inside with an agitator driven rotationally by an operating element located on the outside of the bottle. Known bottles provide a stirring and mixing function for products that have the consistency of a varnish but do not have the characteristics that allow a cosmetic paste to be prepared in a mixing phase during which the agitator must withstand high stresses without damage.

SUMMARY OF THE INVENTION

A goal of the present invention is to create a device for preparing a paste for cosmetic use in a manner sheltered from the air, in particular a paste for dying or bleaching hair, by mixing at least two components of which at least one is in the cream form, comprising a single receptacle and being particularly simple and economical to implement.

The device according to the invention is characterized by the fact that the receptacle is in the form of a cylindrical pot, closed at its upper part by a removable lid, and having at its base a means forming a bearing to receive rotationally the hub of a shaft disposed along the axis of the cylindrical pot, which shaft has, as its periphery, at least one radial blade in the form of a plate attached along one edge of said shaft, said device having outside said cylindrical pot a rotatable operating element integral with said hub, activatable by hand, whereby activation of the operating element causes said shaft and said radial blade or blades to be driven rotationally.

BRIEF DESCRIPTION OF THE DRAWING

The single FIGURE illustrates a schematic elevation, half in cross section, of a device according to the invention.

DETAILED DESCRIPTION OF PREFERRED EMBODIMENTS

The shaft integral with the hub has in one particular embodiment at least one lengthwise groove extending over at least part of its height and able to receive in slidably guided fashion an edge with the shape corresponding to a blade.

In one preferred embodiment the shaft extends beyond the upper end edge of the cylindrical pot so that it engages a cylindrical cavity provided in the lower surface of the lid forming a second rotation bearing for said shaft and also allowing self-centering of the lid on the pot.

The or each plate-shaped radial blade preferably has a substantially rectangular shape with cutouts and extends advantageously lengthwise over most of the height of the pot and radially up to near the pot wall. Radial blade(s) can be made of any suitable material, including metal, plastic, glass or ceramic, for example.

This cylindrical pot can be made of any suitable material, for example metal, ceramic, glass or plastic, but is preferably made of transparent or translucent material and has at least one series of graduations on the height of its side wall.

When one of the components to be mixed is a powder, this is placed in the receptacle first, something which may be done in the factory before the device is packaged for sale.

At the time of use, to produce the mix, one need only remove the lid which is advantageously screwed onto the cylindrical pot, introduce the component in cream form, then, after adding a specific appropriate quantity of solvent, particularly water, close the lid and manually activate the rotatable operating element, whereby the radial blade or blades produce the mix by turning inside the cylindrical pot.

Because of the relatively large cross section of the cylindrical pot, the paste formed can be removed directly, after removal of the lid, with a brush introduced through the opening in the pot. Thus it is no longer necessary to transfer the mixed paste to another receptacle for application.

The rotatable operating element is advantageously a disk knurled on the outside, preferably having an outside diameter substantially equal to the outside diameter of the cylindrical pot and disposed below it.

The knurled disk is advantageously made of plastic in one piece with the hub of the shaft supporting the radial blade or blades.

This brings about direct driving, without gear reduction of the shaft on which the blade or blades is/are mounted, as one rotation of the knurled disk causes one rotation of the shaft. This produces slow stirring preventing any bubbles from being included in the mixture of components.

The means forming a bearing at the base of the cylindrical pot is advantageously made of a continuous cylindrical bearing surface integral with the bottom of the cylindrical pot or a plurality of tongues integral with said bottom, said bearing surface or said tongues having a rib parallel to the base of the pot and able to engage, preferably by latching, an annular groove provided at the periphery of the hub.

The device according to the invention has the additional advantage of being reusable, as the assembly constituted by the external rotatable operating element, the hub, and the shaft supporting the blade or blades can easily be removed from the cylindrical pot with a view to separate cleaning of these elements.

For better understanding of the invention, one embodiment will now be described as a nonlimiting example with reference to the attached drawing.

The device illustrated comprises a cylindrical pot designated overall by 1 having a height essentially the same as its diameter and made of a transparent or translucent plastic material, for example polystyrene or polypropylene.

On its side wall, cylindrical pot 1 is provided with a series of graduations, not shown, extending from the vicinity of its bottom wall 2.

The open, upper end of the cylindrical pot is closed by a lid 3 having a rim 4 provided with an inside thread 5 able to cooperate with an outside thread 6 made on a smaller-diameter end bearing surface 7 of the pot.

When lid 3 is closed, its outer wall is substantially flush with the outer wall of pot 1.

To facilitate screwing it on and unscrewing it, the lid is provided on the outer face of rim 4 with a succession of facets or grips 8.

The device according to the invention also has a knurled disk 9 disposed on bottom wall 2 of the cylindrical pot and mounted to turn relative to the cylindrical pot around axis 10 thereof.

Knurled disk 9 has essentially the same outside diameter as cylindrical pot 1 and its lid 3.

Knurled disk 9, which is preferably made of plastic, is integral with hub 11 of a shaft 12 extending along the axis 10 of the pot.

Shaft 12 has a length such that its end 13, opposite hub 11, is able to engage a cylindrical cavity 14 provided in the inner surface of lid 3 to allow self-centering of the lid on the pot.

In order for it to rotate relative to the cylindrical pot, hub 11 has an annular peripheral groove 15 in which ribs 16 formed on elastic tongues 17 integral with bottom 2 of the cylindrical pot engage by latching.

Several tongues 17 disposed circularly such as to present a bearing for rotation of the hub are provided, which hub, associated with the upper bearing formed by cylindrical cavity 14, ensures perfect retention of the shaft during rotation.

The set of tongues 17 may be replaced by a continuous bearing surface.

Shaft 12 supports at least one blade 18 which, in the example illustrated, is composed of a rectangular plastic plate with cutouts, said plate having a frame 19 and interior inclined struts 20. Strut 21 of blade 18 has an edge 22 arranged to engage slidably in a lengthwise groove 23 of shaft 12.

The device according to the invention may have one or more radial blades 18 each engaging in a corresponding groove of the shaft.

The radial blade or blades can thus be separably attached to shaft 12, or alternatively they can be made in one piece with it.

Of course the invention is not limited to blades with the particular shape illustrated.

The device according to the invention, particularly when intended for preparation of a paste for dying or bleaching hair, can be prefilled with a measured preset quantity of dye or bleach powder and packed in a package comprising a tube containing the cream which is to be mixed with the dye or bleach powder, a brush for application of the paste formed, and if necessary a metering means if another liquid component such as water is to be added to the mix.

Although the invention has been described in conjunction with one particular embodiment, it is obviously not limited thereto and many alternatives and modifications could be created without thereby departing either from its framework or its spirit.

What is claimed is:

1. Device for preparing a paste for cosmetic use in a manner sheltered from the air by mixing at least two components of which at least one is in the form of cream, said device comprising a closed receptacle provided with a removable closing means, into which the components are successively introduced in a metered manner, wherein the receptacle is in the form of a cylindrical pot closed at an upper part by said removable closing means, and having at a base a bearing forming means, said device further comprising a rotatable operating element, and a shaft with a hub disposed along an axis of the cylindrical pot, said operating element being outside said cylindrical pot and integral with said hub of said shaft, said shaft having at least one radial blade at a periphery of said shaft, wherein said bearing forming means rotationally receives said hub, and whereby activation of the operating element causes said shaft and said radial blade or blades to be driven rotationally.

2. Device according to claim 1, wherein the shaft extends beyond the upper end edge of the cylindrical pot in order to engage an end of the shaft into a cylindrical cavity provided in the lower surface of the removable closing means, forming a second rotation bearing for said shaft and also allowing the removable closing means to be self-centered onto the pot.

3. Device according to claim 1, wherein the or each radial blade, in a shape of a plate, has an essentially rectangular shape with cutouts.

4. Device according to claim 3, wherein the or each radial blade extends lengthwise over most of the height of the pot.

5. Device according to claim 3, wherein the or each radial blade extends radially up to the vicinity of the pot wall.

6. Device according to claim 1, wherein the shaft, integral with the hub, has at a periphery at least one lengthwise groove extending over at least part of the shaft height and able to receive, in slidably guided fashion, an edge with a shape corresponding to a radial blade.

7. Device according to claim 1, wherein the cylindrical pot is made of transparent or translucent material and has at least one series of graduation marks on a side wall height.

8. Device according to claim 7, wherein said transparent or translucent material is a plastic.

9. Device according to claim 1, wherein the operating element is a disk knurled on an outside portion, and which preferably has an outside diameter essentially equal to an outside diameter of the cylindrical pot, said operating element being disposed below the cylindrical pot.

10. Device according to claim 9, wherein the knurled disk is made of plastic in one piece with the hub of the shaft supporting the radial blade or blades.

11. Device according to claim 1, wherein the bearing forming means provided at the base of the cylindrical pot is a continuous cylindrical bearing surface integral with the bottom of the cylindrical pot or a plurality of tongues integral with said bottom, said bearing surface or said tongues having a grid parallel to the base of the pot and able to engage in an annular groove provided at the periphery of the hub.

12. Device according to claim 11, wherein said grid engages said annular groove by latching.

13. Device according to claim 1, wherein said removable closing means is a lid.

14. Device according to claim 1, wherein the paste for cosmetic use is a paste for dying or bleaching hair.

15. Device according to claim 1, wherein said operating element is activatable by hand.

* * * * *